US007042485B2

(12) United States Patent
Hall

(10) Patent No.: US 7,042,485 B2
(45) Date of Patent: May 9, 2006

(54) EXPOSURE ASSEMBLIES, PRINTING SYSTEMS AND RELATED METHODS

(75) Inventor: Jeffrey D. Hall, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/458,121

(22) Filed: Jun. 10, 2003

(65) Prior Publication Data

US 2004/0252183 A1 Dec. 16, 2004

(51) Int. Cl.
*B41J 27/00* (2006.01)

(52) U.S. Cl. ..... 347/244; 347/258

(58) Field of Classification Search ..... 347/237, 347/241–242, 244, 247, 249, 256–258; 359/212, 359/245, 319, 322, 323, 383, 298, 354, 694, 359/819–822; 501/136; 345/96, 519; 708/190
See application file for complete search history.

(56) References Cited

U.S. PATENT DOCUMENTS

| | | | | |
|---|---|---|---|---|
| 4,872,743 | A * | 10/1989 | Baba et al. | 359/298 |
| 5,124,835 | A * | 6/1992 | Shibaguchi et al. | 359/319 |
| 5,135,897 | A * | 8/1992 | Uchino et al. | 501/136 |
| 5,177,475 | A * | 1/1993 | Stephany et al. | 345/96 |
| 5,212,583 | A * | 5/1993 | Vali et al. | 359/245 |
| 5,877,886 | A * | 3/1999 | Ishii et al. | 359/212 |
| 6,340,986 | B1 * | 1/2002 | Morrison et al. | 347/249 |

* cited by examiner

*Primary Examiner*—Hai Pham

(57) ABSTRACT

Systems, methods, and assemblies are provided for focusing light on a photoconductor. In one embodiment, an exposure assembly is provided. The exposure assembly includes an array of light-focusing structures. The light-focusing structures include a plurality of lenses. The individual lenses include a material that is deformable sufficient to focus light upon a photoconductor.

57 Claims, 7 Drawing Sheets

EXPOSURE ASSEMBLIES, PRINTING SYSTEMS AND RELATED METHODS

BACKGROUND

Many printing systems, such as those employed by various laser printers (and copy machines, multi-function printers and the like), utilize a printing process that is known as electrophotographic printing or, more simply, EP printing. Systems that are employed in EP processes are often fairly complex and designed within tight tolerances, all of which combines for a somewhat expensive product.

As an example, consider the following. In many laser printers, a laser source produces a laser that is projected towards a rapidly rotating polygonal mirror assembly having multiple facets. The mirror reflects the laser onto a rotating optical photoconducting drum or "OPC" whose surface is selectively charged or discharged in accordance with locations that are illuminated by the laser. This, in turn, allows toner to be selectively applied to the OPC in accordance with the print job that was received, which toner can then be applied to a print medium and suitably fused thereon.

As the printer receives data that is to be printed on the print medium, the data is processed into raster data that is used to modulate the laser. Raster data can be thought of as a series of 1s and 0s that are used to either turn the laser on or off. Raster data is typically used to serially modulate the laser as the mirror assembly rotates. That is, each facet of the mirror assembly typically corresponds to one line on the page. As the mirror assembly rotates through one facet, the raster data serially modulates the laser to produce one scan line on the OPC. As the next facet advances into the path of the laser, the raster data again serially modulates the laser to produce another adjacent scan line, and so on.

The desired rates of forming images on media can result in scanning assemblies that operate at high rotational rates. In addition, precise control of the scanning mirror rotational rate helps to achieve precise control of the position of discharged areas on scan lines. Furthermore, complex lenses are used to focus the laser on the surface of the photoconductor as the laser is swept across the scan line. Design constraints such as these contribute to the expense associated with scanning assemblies.

SUMMARY

In one embodiment, an exposure assembly comprises an array of light-focusing structures. The light-focusing structures comprise a plurality of lenses with individual lenses comprising a material that is deformable sufficient to focus light upon an photoconductor.

DETAILED DESCRIPTION

Overview

Figure 1:
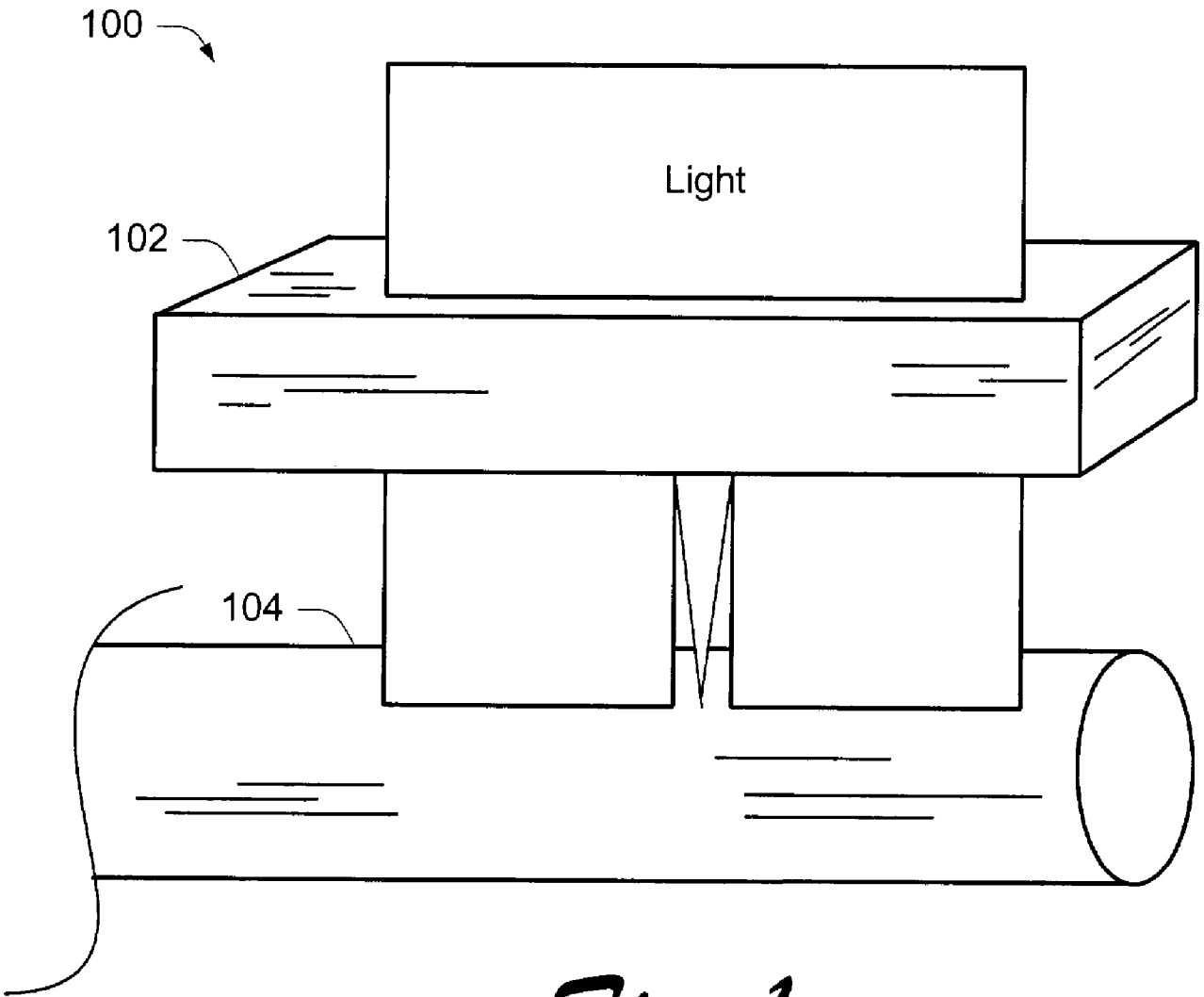
FIG. 1 shows a high level view of components of an exemplary exposure assembly in accordance with one embodiment.

FIG. 1 shows a high level view of components of an exemplary exposure assembly in accordance with one embodiment, generally at 100. In this example, exposure assembly 100 comprises an array of microlenses 102 positioned proximate a photoconductor 104. The microlens array 102 comprises a plurality of individual lenses that can be utilized to selectively focus a substantially uniform field of light (such as a laser, monochromatic light, white light, or various other fields) upon photoconductor 104. Individual lenses can be formed from a material that is deformable sufficient to focus light on the photoconductor. The lens array can be driven by parallel data such that one or more scans lines can be contemporaneously scanned onto the photoconductor. In this specifically illustrated example, one lens of the microlens array 102 is being utilized to focus the field of light to a high intensity level that is sufficient to change the electrical properties of the photoconductor. In this manner, the microlens array can be utilized to replace scanning subassemblies that utilize complex rotating mirror assemblies, lens assemblies and the like.

Exemplary Lens Assembly

Figure 2:
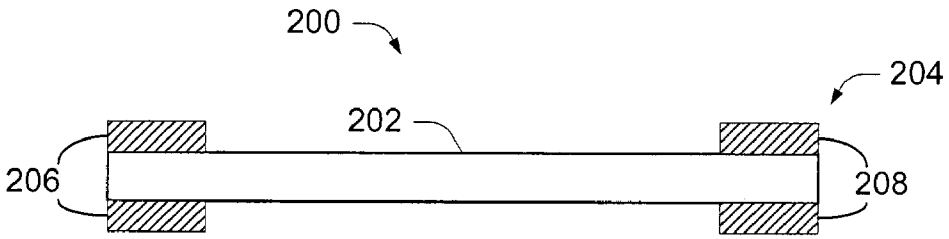
FIG. 2 illustrates an exemplary individual lens assembly of a microlens array in accordance with one embodiment without a voltage applied to the lens assembly.
Figure 3:
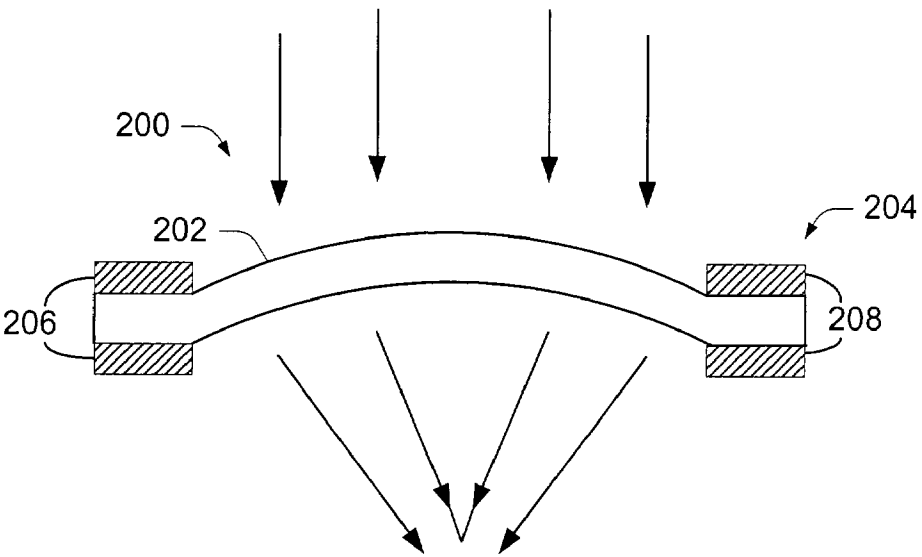
FIG. 3 illustrates an exemplary individual lens assembly of a microlens array in accordance with one embodiment with a voltage applied to the lens assembly.

FIGS. 2 and 3 illustrate, in accordance with one embodiment, an exemplary individual lens assembly of microlens array 102, generally at 200. In this example, lens assembly 200 comprises a lens 202 and an electrode assembly 204. In one embodiment, electrode assembly 204 comprises a first pair of top and bottom electrodes 206, and a second pair of top and bottom electrodes 208. The electrode pairs 206, 208 are operably mounted proximate lens 202 for a purpose that will become evident below.

In accordance with one embodiment, lens 202 is formed from an electro-optical material whose light transmission properties can change in accordance with whether a potential is applied to it or not. For example, the lens 202 can be formed from a piezoelectric material such as PZT, PLZT (Lead Lanthanum Zirconate Titanate), and the like. Other materials such as aluminum oxide ($Al_2O_3$) and similar piezoelectric or ferroelectric materials might be used as well.

FIG. 2 illustrates lens 202 in an off or relaxed position. In this position, the lens can allow light to pass through at a desired intensity that is not sufficient to affect the optical characteristics of the photoconductor.

FIG. 3, on the other hand, illustrates lens 202 in a position in which a voltage has been applied to it by way of its associated electrodes. In this position, and because of its piezoelectric properties, the lens deforms in a manner that focuses the field of light onto a particular spot on the photoconductor, thus affecting its optical characteristics.

Exemplary Technique for Forming the Lens Array

As noted above, the lenses of lens assembly 200 can be formed from any suitable material having properties that are suitable for use as a lens. In the particular example above, this material comprises a piezoelectric material that deforms responsive to a voltage being applied to it. Deformation of the material of the lens enables the lens to focus a field of light at a particular focal point that is useful for affecting the charge characteristics of an photoconductor. As there are different materials that might be used for the material of the lenses and the electrodes, there are different techniques that can be employed to form lens assemblies that incorporate the lenses and electrodes. The process described below constitutes but one exemplary process that can be utilized for forming a suitable lens assembly. It should be appreciated and understood that other techniques can be employed without departing from the spirit and scope of the claimed subject matter.

Figure 4:
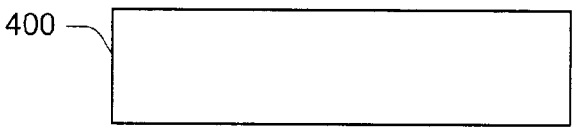
FIG. 4 is a diagrammatic view of a substrate, in process, in accordance with one embodiment.

Referring to FIG. 4, a substrate is shown in process generally at 400. The substrate can comprise any suitable material that is typically utilized in processes like and/or similar to the process described below. In one embodiment, substrate 400 comprises a silicon substrate or wafer.

Figure 5:
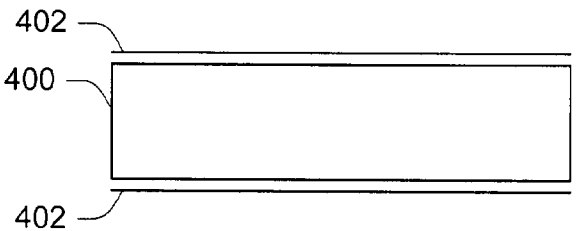
FIG. 5 is a diagrammatic view of the FIG. 4 substrate, in process, in accordance with one embodiment.

Referring to FIG. 5, an insulative layer of material 402 is formed over the substrate and, in particular, over the substrate's top and bottom surfaces. Any suitable insulative material can be utilized. In one embodiment, layer 402 is formed by exposing the substrate to oxidation conditions effective to form a layer comprising $SiO_2$ over the substrate. In one embodiment, layer 402 is formed to a thickness of about 500 nm.

Figure 6:
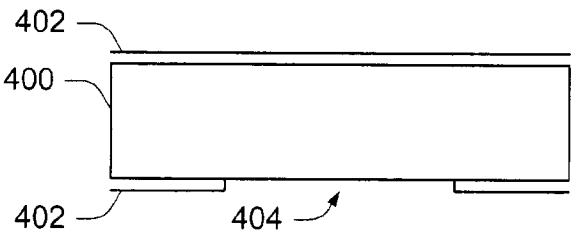
FIG. 6 is a diagrammatic view of the FIG. 5 substrate, in process, in accordance with one embodiment.

Referring to FIG. 6, substrate 400 is patterned and etched to form an opening 404 over portions of the backside of the substrate. Opening 404 corresponds to an area proximate which an individual lens of the lens assembly is to be formed. Accordingly, a number of different similar openings are formed over the substrate. The openings can be form by using an isotropic etch comprising, for example, HF.

Figure 7:
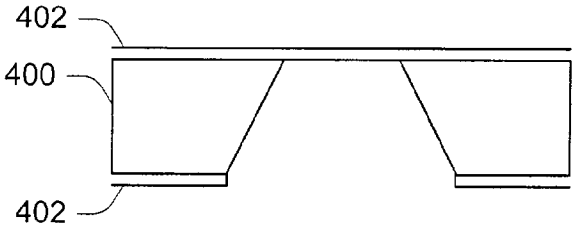
FIG. 7 is a diagrammatic view of the FIG. 6 substrate, in process, in accordance with one embodiment.

Referring to FIG. 7, portions of substrate 400 are removed through opening 400 by, for example, an EDP anisotropic etch.

Figure 8:
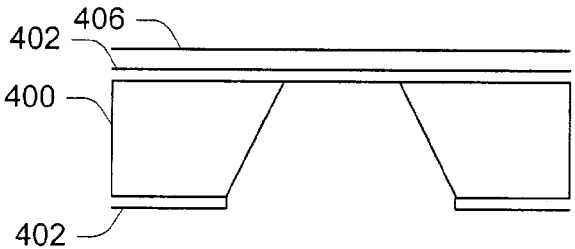
FIG. 8 is a diagrammatic view of the FIG. 7 substrate, in process, in accordance with one embodiment.

Referring to FIG. 8, a layer of conductive material 406 is formed over the substrate over the insulative layer that was not etched to form openings 404. Layer 406 can comprise any suitable material and constitutes the material from which the bottom electrodes of the lens assembly are to be formed. The material can be formed using any suitable technique. In one embodiment, layer 406 can be formed by sputtering the material over the substrate. Other techniques can, of course, be utilized. For example, layer 406 could be deposited through chemical vapor deposition or, more generally, through any suitable vapor deposition techniques. Suitable materials from which to form layer 406 comprise titanium, platinum, gold and aluminum. In one embodiment, either titanium or platinum is utilized. Further, a 20 nm layer of Ti covered by a 200 nm layer of Pt would be a stable bottom electrode configuration.

Figure 9:
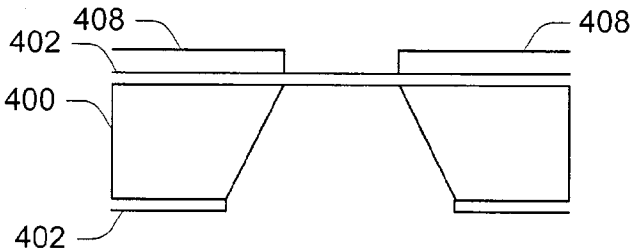
FIG. 9 is a diagrammatic view of the FIG. 8 substrate, in process, in accordance with one embodiment.

Referring to FIG. 9, layer 406 is patterned and etched to form individual electrodes 408. Once a pattern layer is formed over layer 406 (such as photoresist), the layer can be etched using, for example, phosphoric and nitric acid.

Figure 10:
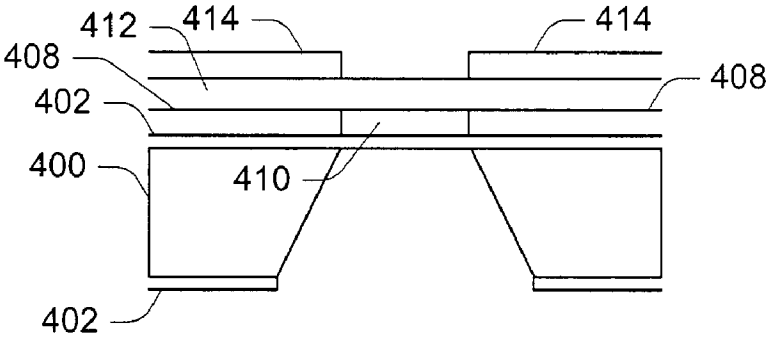
FIG. 10 is a diagrammatic view of the FIG. 9 substrate, in process, in accordance with one embodiment.

Referring to FIG. 10, the substrate can be exposed to atmospheric conditions effective to form a layer of oxide 410 over the substrate and between electrodes 408. Alternately, layer 410 can comprise photoresist or some other layer of filler material. Subsequently, a layer of lens material 412 is formed over the substrate. The lens material can comprise any suitable material. In one embodiment, the lens material comprises PZT or PLZT. Such material can be formed over the substrate using any suitable technique. For example, the material can be formed through sputter deposition or a technique known as sol-gel. Sol-gel techniques typically involve a solution deposition where, for example, the material that is to comprise the lens is applied over the substrate in a solution form. The substrate is then spun at a high RPM sufficient to evenly distribute the material over the substrate to a desired thickness. The material can then be solidified by curing or otherwise allowing the material to dry. This technique can then be repeated for form several thin layers of material over the substrate. A final sintering step can be performed to align and orient the crystals.

Following formation of the layer of lens material, a layer of conductive material can be formed over the substrate and patterned and etched to form top electrodes 414. The same techniques and materials that were utilized to form the bottom electrodes 408 can be utilized to form the top electrodes 414.

Figure 11:
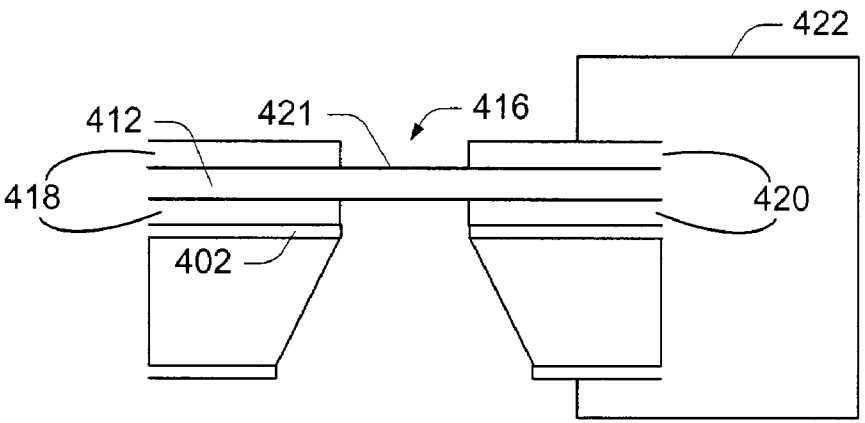
FIG. 11 is a diagrammatic view of the FIG. 10 substrate, in process, in accordance with one embodiment.

Referring to FIG. 11, portions of the layer of $SiO_2$ 402 and the oxide layer 410 are removed from adjacent layer 412 to provide a lens assembly 416 having a first pair of top and bottom electrodes 418, a second pair of top and bottom electrodes 420, and an associated lens 421. The lens assembly or lens array can then be encased in a suitable material such as plastic 422.

Exemplary Exposure Assembly

Figure 12:
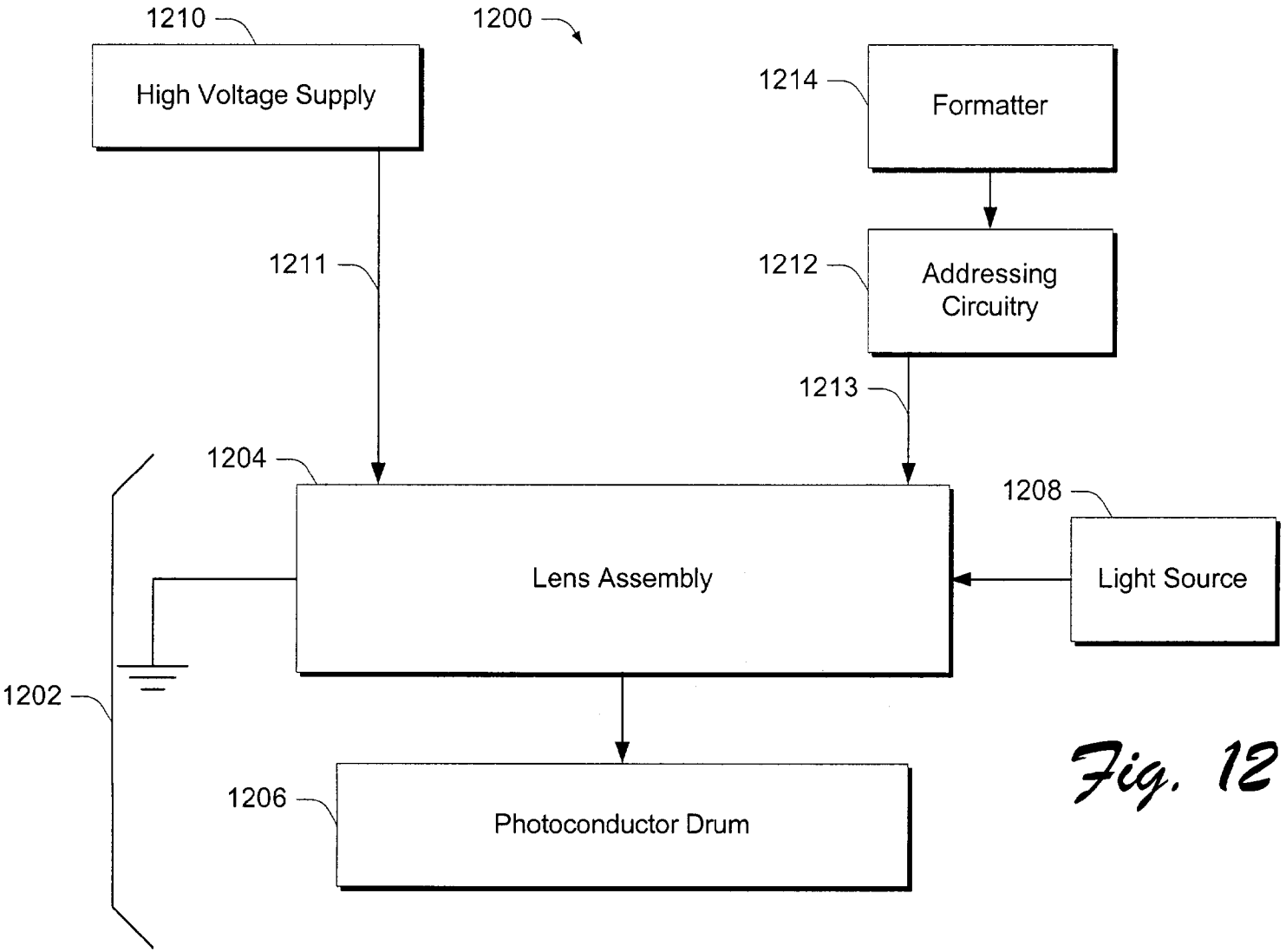
FIG. 12 shows an exemplary exposure assembly in accordance with one embodiment.
Figure 13:
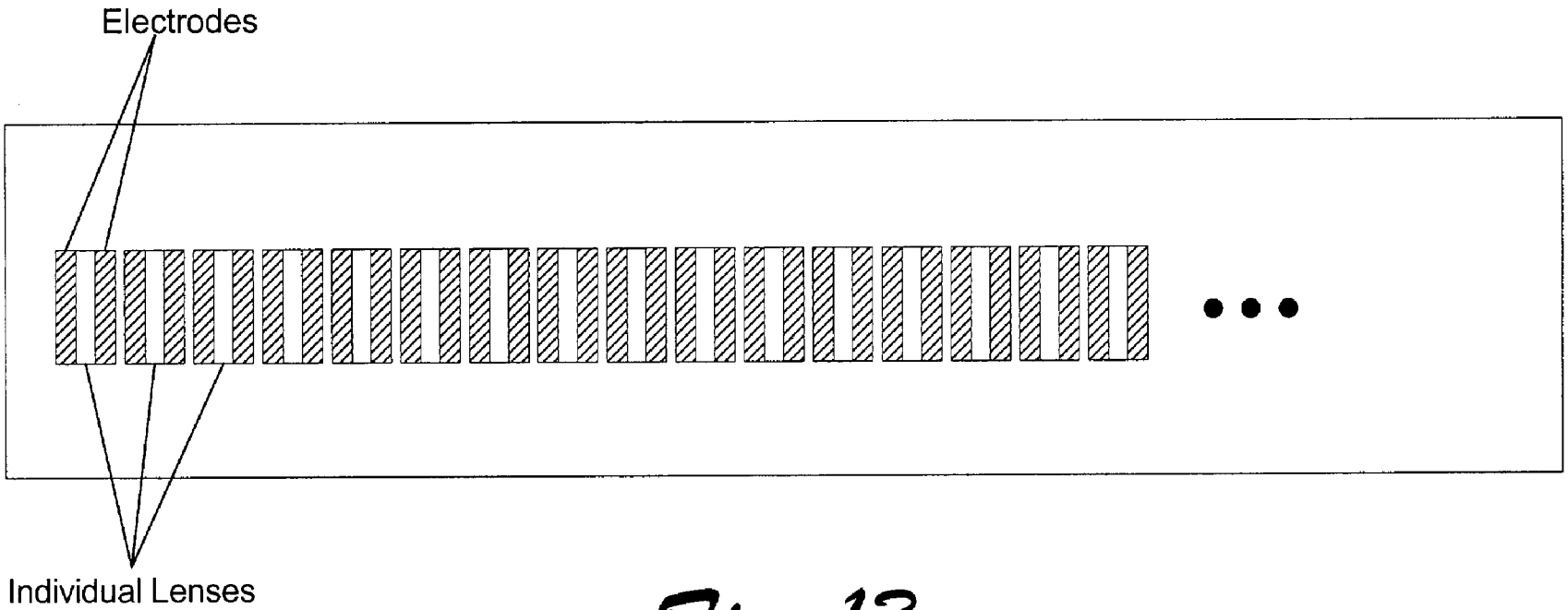
FIG. 13 shows a top plan view of lens assembly in accordance with one embodiment.

FIG. 12 shows an exemplary exposure assembly in accordance with one embodiment generally at 1200. Assembly 1200 comprises an exposure sub-assembly 1202 comprising a lens assembly or array of microlenses 1204, a photoconductor 1206 such as an OPC drum, and a source of light 1208. A top plan view of a portion of microlens array 1204 is shown in FIG. 13.

Lens assembly 1204 can comprise a single row of lenses. Alternately or additionally, the lens assembly can comprise multiple rows of lenses. In accordance with one embodiment, each individual lens of the lens assembly corresponds to one dot. So, for example, in a printing device that prints at 600 DPI (dots per inch), there would be one lens for each dot of the DPI. FIG. 13 shows a top plan view of lens assembly 1204 where the individual electrodes and lens are designated as shown.

Assembly 1200 also comprises a high voltage supply 1210 that supplies a high voltage to lens assembly 1204 via a control line 1211. Addressing circuitry 1212 is provided for individually addressing each lens in accordance with data that is to be printed on a print medium. Addressing circuitry 1212 is coupled to lens assembly 1204 via a parallel signal line 1213. The addressing circuitry comprises individual address lines each of which is connected with a particular lens via its top and bottom electrode pairs.

A formatter 1214 is provided and is coupled to addressing circuitry 1212. In one embodiment, the formatter comprises an application specific integrated circuit or ASIC that is configured to process page information comprising a print job into parallel data that is provided to the addressing circuitry for addressing individual lenses of the lens assembly 1204.

In Operation

In operation, when a print job is received, formatter 1214 processes the print job's data into parallel "line" data that is then provided to addressing circuitry 1212. The addressing circuitry 1212, in accordance with the data that it receives, addresses particular individual lenses of lens assembly 1204. When a particular lens is addressed, a voltage from the high voltage supply 1210 is applied to the lens causing it to assume the configuration shown in FIG. 3, thereby focusing light from light source 1208 onto the photoconductor 1206. When the focused light strikes the photoconductor, it modifies its charge characteristics thus forming what is known as a latent image on the drum. As the drum rotates, it accumulates toner over the latent image that is subsequently applied to a print medium, such as paper, and fused thereon.

In accordance with one embodiment, an entire scan line of the photoconductor is scanned at the same time. That is, individual dots comprising a single scan line are created at the same time by having the appropriate lenses of the lens assembly focus its associated incident light at the same time. Thus, data is scanned onto the photoconductor in parallel, rather than in series.

It is to be appreciated that the data that is received by the formatter 1214 can come from a scanning pipeline, a copying pipeline, a printer pipeline, a print file, as a facsimile and the like.

Exemplary Printer System

Figure 14:
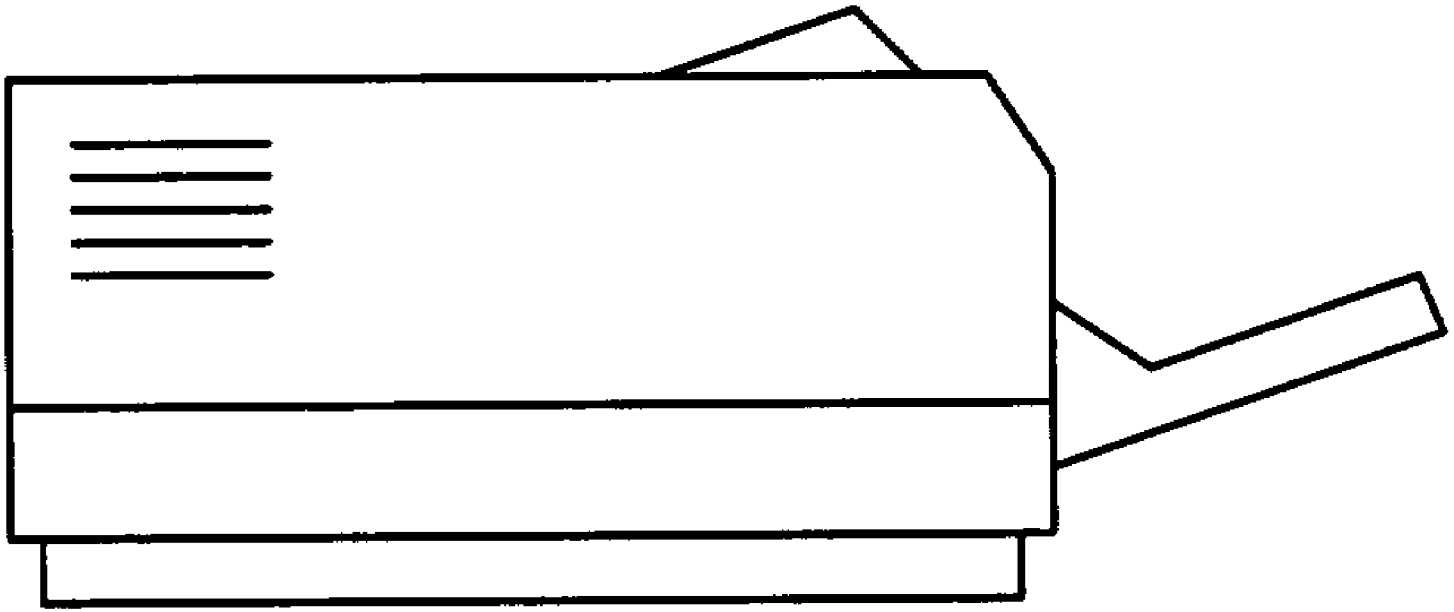
FIG. 14 shows an exemplary printing system in which various embodiments can be employed.

FIG. 14 shows an exemplary printing system in which the various embodiments described above can be employed. In this example, the printing system comprises a printer. It is to be appreciated that the illustrated system constitutes but one system in connection with which the embodiments can be employed. Accordingly, other printing systems (copiers, multi-function printers and the like) can be utilized without departing from the spirit and scope of the claimed subject matter.

Conclusion

The embodiments described above can increase the speed with which data is delivered to an photoconductor and can desirably increase the accuracy and reliability of the scanning subsystem (e.g. a single lens failure does not result in a complete product failure). Further, the described embodiments are generally less costly alternatives for costly scanning assemblies that include highly polished mirror assemblies and complex control and monitoring circuitry.

Although the embodiments of the invention have been described in language specific to structural features and/or methodological steps, it is to be understood that the invention defined in the appended claims is not necessarily limited to the specific features or steps described. Rather, the specific features and steps are disclosed as preferred forms of implementing the claimed invention.

The invention claimed is:

1. A printing device scanning sub-assembly comprising:

an array of light focusing structures;

the light focusing structures comprising a plurality of lenses;

individual of the lenses comprising a material that is deformable when a potential is applied directly to the material in order to focus light upon a photoconductor;

an ASIC that is configured to process a print job into parallel line data for addressing individual lenses of a lens assembly; and wherein an entire scan line of the photoconductor is scanned at the same time.

2. The printing device scanning sub-assembly of claim 1, wherein the array is configured to be driven by parallel data such that one or more scan lines can be contemporaneously scanned onto the photoconductor.

3. The printing device scanning sub-assembly of claim 1, further comprising a light source for projecting light that is to be focused by the array.

4. The printing device scanning sub-assembly of claim 1, wherein said material comprises a piezoelectric material.

5. The printing device scanning sub-assembly of claim 1, wherein said material comprises a piezoelectric material comprising PZT.

6. The printing device scanning sub-assembly of claim 1, wherein said material comprises a piezoelectric material comprising PLZT.

7. The printing device scanning sub-assembly of claim 1, wherein said material comprises a piezoelectric material comprising one or more of PZT and PLZT.

8. The printing device scanning sub-assembly of claim 1, wherein said material comprises aluminum oxide.

9. The printing device scanning sub-assembly of claim 1, further comprising an electrode assembly associated with individual of the lenses of the array, the electrode assembly being configured to apply a voltage to its associated lens sufficient to cause the lens to deform.

10. A printing device embodying the scanning sub-assembly of claim 1.

11. A printing device scanning sub-assembly comprising:

an array of light-focusing structures;

the light-focusing structures comprising a plurality of lenses;

individual of the lenses comprising an electro-optical material whose light transmission properties can change in accordance with whether a potential is applied directly to the material;

the light transmission properties being changeable sufficient to focus light upon a photoconductor;

an ASIC that is configured to process a print job into parallel line data for addressing individual lenses of the array of light-focusing structures; and wherein an entire scan line of the photoconductor is scanned at the same time.

12. The printing device scanning sub-assembly of claim 11, wherein the array is configured to be driven by parallel data such that one or more scan lines can be contemporaneously scanned onto the photoconductor.

13. The printing device scanning sub-assembly of claim 11 further comprising a light source for projecting light that is to be focused by the array.

14. The printing device scanning sub-assembly of claim 11 further comprising a laser light source for projecting light that is to be focused by the array.

15. A printing device embodying the scanning sub-assembly of claim 11.

16. A printing device scanning sub-assembly comprising:

an array of light-focusing structures;

the light-focusing structures comprising a plurality of lenses;

individual of the lenses comprising an electro-optical material whose light transmission properties can changes in accordance with whether a potential is applied directly to the material;

the light transmission properties being changeable sufficient to focus light upon a photoconductor;

a light source for projecting the light that is to be focused by the array; and an ASIC that is configured to process a print job into parallel line data for addressing individual lenses of the array of light-focusing structures; and the ASIC being coupled with the array and configured to drive the array with parallel line data such that one or more entire scan lines can be contemporaneously scanned onto the photoconductor.

17. The printing device scanning sub-assembly of claim 16, wherein the light source comprises a laser source.

18. The printing device scanning sub-assembly of claim 16, wherein the array comprises a single row of light-focusing structures.

19. The printing device scanning sub-assembly of claim 16, wherein the array comprises multiple rows of light-focusing structures.

20. The printing device scanning sub-assembly of claim 16, wherein each of the individual of lenses corresponds to a DPI dot.

21. The printing device scanning sub-assembly of claim 16, wherein the electro-optical material comprises a deformable material.

22. The printing device scanning sub-assembly of claim 16, wherein the electro-optical material comprises a deformable piezoelectric material.

23. The printing device embodying the scanning sub-assembly of claim 16.

24. A printing device comprising:

an array of light-focusing structures comprising a plurality of lenses, individual of the lenses comprising a piezoelectric material that is deformable in accordance with whether a potential is applied directly to the material;

a photoconductor positioned proximate the array and configured to have light focused thereon by the array;

a light source for projecting the light that is to be focused by the array onto the photoconductor;

an ASIC that is configured to process a print job into parallel line data for addressing individual lenses of the array of light-focusing structures;

the ASIC being coupled with the array and configured to drive the array with parallel line data such that one or more entire scan lines can be contemporaneously scanned onto the photoconductor; and a high voltage supply coupled with the array and configured to provide a high voltage to the array.

25. The printing device of claim 24, wherein the light source comprises a laser source.

26. The printing device of claim 24, wherein the light array comprises a single row of light-focusing structures.

27. The printing device of claim 24, wherein the light array comprises multiple row of light-focusing structures.

28. The printing device of claim 24, wherein each of the individual of the lenses corresponds to a DPI dot.

29. The printing device of claim 24, wherein the piezoelectric material comprises PZT.

30. The printing device of claim 24, wherein the piezoelectric material comprises PLZT.

31. The printing device of claim 24, wherein the piezoelectric material comprises one or more of PZT and PLZT.

32. The printing device of claim 24 further comprising a formatter coupled with the addressing circuitry and configured to process page information comprising a print job into parallel data that is provided to the addressing circuitry.

33. A method of fabricating lens assemblies comprising:

providing a substrate;

forming a plurality of lens sub-assemblies over the substrate, individual ones of which comprise at least one pair of electrodes and an associated lens, the lenses formed from a material that is deformable sufficient to focus light upon a photoconductor;

forming individual lenses of the lens assemblies to be addressed using an ASIC that is configured to process a print job into parallel line data; and forming the assemblies such that an entire scan line of the photoconductor can be scanned at the same time.

34. The method of claim 33, wherein the act of forming is performed by forming the lenses from a piezoelectric material.

35. the method of claim 33, wherein the act of forming is performed by forming the lenses from a piezoelectric material comprising PZT.

36. the method of claim 33, wherein the act of forming is performed by forming the lenses from a piezoelectric material comprises PLZT.

37. A method comprising:

providing an array of light-focusing structures comprising a plurality of lenses, individual of the lenses comprising a material that is deformable to focus light in accordance with whether a potential is applied directly to the material;

associating a photoconductor with the array positioned proximate the array and configured to have the light focused thereon by the array;

associating a light source with the array configured to project the light to be focused by the array onto the photoconductor;

addressing individual lenses of the array of light-focusing structures using an ASIC that is configured to process a print job into parallel line data;

coupling with the array the ASIC, which is configured to drive the array with parallel line data such that the one or more entire scan lines can be contemporaneously scanned onto the photoconductor; and coupling a supply to the array configured to provide voltage to the array.

38. the method of claim 37, wherein the light source comprises a laser source.

39. The method of claim 37, wherein the array comprises a single row of light-focusing structures.

40. the method of claim 37, wherein the array comprises multiple rows of light-focusing structures.

41. The method of claim 37, wherein each individual of the lenses corresponds to a DPI dot.

42. The method of claim 37, wherein the material comprises PZT.

43. The method of claim 37, wherein the material comprises PLZT.

44. The method of claim 37, wherein the material comprises one or more of PZT and PLZT.

45. The method of claim 38 further comprising coupling a formatter with the addressing circuitry, the formatter being configured to process page information comprising a print job into parallel data that is provided to the addressing circuitry.

46. The method of claim 37, wherein the act of providing an array of light-focusing structures comprises providing a plurality of the lenses comprising at least one piezoelectric material.

47. A method comprising processing data of a print job into parallel line data;

applying voltage directly to individual ones of deformable lenses in an array according to the parallel line data to allow the individual ones to deform sufficient to focus light to modify charge characteristics of a photoconductor;

addressing individual lenses of the array using an ASIC that is configured to process a print job into parallel line data; and having appropriate ones of deformable lenses in the array focus to create individual dots on a single scan line at the same time.

48. The method of claim 47, wherein the act of applying voltage to the individual one of the deformable lenses produces an individual scan line on the photoconductor.

49. The method of claim 47, wherein the array comprises a single row of lenses.

50. The method of claim 47, wherein the array comprises multiple rows of lenses.

51. The method of claim 47, wherein each of the individual deformable lenses corresponds to a DPI dot.

52. The method of claim 47, wherein the deformable lenses comprise PZT.

53. The method of claim 47, wherein the deformable lenses comprise PLZT.

54. The method of claim 47, wherein the deformable lenses comprise one or more of PZT and PLZT.

55. An apparatus comprising:

means for processing data of a print job into parallel line data;

means for deformably focusing light on a photoconductor in accordance with said parallel line data sufficient to modify charge characteristics of said photoconductor, wherein appropriate lenses of a lens assembly focus when a potential is applied directly to the appropriate lenses to create individual dots on an entire scan line at the same time; and means for addressing individual lenses of the lens assembly using an ASIC that is configured to process a print job into parallel line data.

56. The apparatus of claim 55, wherein said means for deformably focusing light comprises piezoelectric lenses.

57. A printer embodying the apparatus of claim 55.

* * * * *